US007632066B2

(12) United States Patent
Arai et al.

(10) Patent No.: US 7,632,066 B2
(45) Date of Patent: Dec. 15, 2009

(54) PIPE FOR STEAM TURBINE, MANUFACTURING PROCESS OF SAME, MAIN STREAM PIPE AND REHEAT PIPE FOR STEAM TURBINE, AND STEAM TURBINE POWER PLANT USING THOSE PIPES

(75) Inventors: Masahiko Arai, Hitachinaka (JP); Hirotsugu Kawanaka, Hitachi (JP); Hiroyuki Doi, Tokai (JP); Kenichi Murata, Hitachi (JP); Hajime Toriya, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 367 days.

(21) Appl. No.: 11/480,978

(22) Filed: Jul. 6, 2006

(65) Prior Publication Data

US 2007/0014671 A1 Jan. 18, 2007

(30) Foreign Application Priority Data

Jul. 7, 2005 (JP) ..... 2005-198474

(51) Int. Cl.
*F01D 25/00* (2006.01)

(52) U.S. Cl. ..... 415/200; 415/211.2

(58) Field of Classification Search ..... 415/200, 415/211.2; 164/114, 122, 122.1, 268; 148/325, 148/333; 420/38, 69, 64, 106, 107
See application file for complete search history.

(56) References Cited

U.S. PATENT DOCUMENTS

| | | | | |
|---|---|---|---|---|
| 2,931,744 | A * | 4/1960 | Samuels | 148/592 |
| 3,568,752 | A * | 3/1971 | Williams | 164/47 |
| 5,021,215 | A * | 6/1991 | Sawaragi et al. | 420/584.1 |
| 5,964,091 | A | 10/1999 | Fukui et al. | |
| 6,182,439 | B1 * | 2/2001 | Siga et al. | 60/39.182 |
| 6,338,241 | B1 * | 1/2002 | Shibuya et al. | 60/39.182 |
| 6,358,004 | B1 * | 3/2002 | Shiga et al. | 415/200 |
| 6,419,453 | B2 * | 7/2002 | Fukui et al. | 416/241 R |
| 7,065,968 | B2 * | 6/2006 | Takahashi et al. | 60/670 |

FOREIGN PATENT DOCUMENTS

| | | |
|---|---|---|
| JP | 59-116360 | 7/1984 |
| JP | 02-290950 | 11/1990 |

* cited by examiner

*Primary Examiner*—Ninh H Nguyen
(74) *Attorney, Agent, or Firm*—Brundidge & Stanger, P.C.

(57) ABSTRACT

A pipe for a steam turbine is formed of a centrifugal casting material to achieve resistance against higher temperatures and improve reliability of the pipe by employing, as a pipe material, a centrifugal casting material normalized to contain uniform and finer crystal grains. The centrifugal casting material is made of steel having a columnar structure in the radial direction with the crystal grain size number of 5 or more in a plane perpendicular to the radial direction. The steel includes 0.05-0.5% by mass C, not more than 1.0% Si, 0.05-1.5% Mn, 0.01-2.5% Ni, 8.0-13.0% Cr, 0.05-2.5% Mo, not more than 3.0% W, 0.05-0.35% V, 0.01-0.5% Nb, not more than 5% Co, 0.01-0.1% N, not more than 0.03% B, and not more than 0.05% Al.

12 Claims, 4 Drawing Sheets

PIPE FOR STEAM TURBINE, MANUFACTURING PROCESS OF SAME, MAIN STREAM PIPE AND REHEAT PIPE FOR STEAM TURBINE, AND STEAM TURBINE POWER PLANT USING THOSE PIPES

BACKGROUND OF THE INVENTION

1. Field of the Invention

The present invention relates to a novel pipe for a steam turbine, which is formed of a centrifugal casting pipe having high detection accuracy by an ultrasonic flaw detection test, and a manufacturing process of the novel pipe. The present invention also relates to a main steam pipe and a reheat pipe for a steam turbine, which are manufactured by employing the above process, and a steam turbine power plant using those pipes.

2. Description of the Related Art

In a steam turbine power plant, an operating life of the plant is affected, in particular, by soundness of a main steam pipe exposed to main steam among pipes exposed to high-temperature and high-pressure steam. If there is any defect inside the pipe, corrosion and/or cracks occur starting from the defect, thus resulting in a reduction of the operating life. In order to prevent troubles of damage and leakage during use, it is important to inspect the presence or absence of defects inside the pipe in the manufacturing and use of the pipe. Generally, a material test is carried out as a non-destructive test.

Non-destructive tests include, e.g., an ultrasonic flaw detection test (UT), a radiation flaw detection test (RT), a magnetic-powder flaw detection test (MT) which are specified in and carried out in conformity with JIS G0582, JIS G0581 and JIS G0565, respectively. Among them, the ultrasonic flaw detection test (UT) is advantageous from the viewpoint of accuracy in detecting the position and size of an internal defect.

Pipe materials are made of carbon steel, low-alloy steel, and a high-Cr alloy depending on temperature in use. At steam temperature of not lower than 550° C. corresponding to a target level of development and practical use which have recently been progressed with intent to increase temperature and pressure of steam from the viewpoint of energy saving, high-Cr martensitic steel is used which contains 8-13% of Cr and has high resistance against temperature and environment. As examples of alloy composition, 9%-Cr forged steel and 12%-Cr forged steel are specified respectively in Ka-SFVAF28 and Ka-SUS410J3 in technical standards for thermal power generation equipment. The alloy compositions of those forged steels are disclosed in, e.g., Patent Document 1 (JP,A 59-116360) and Patent Document 2 (JP,A 2-290950).

SUMMARY OF THE INVENTION

Those known 9%-Cr forged steel and 12%-Cr forged steel can be enhanced in temperature resistance to be adaptable for higher temperatures by containing a larger amount of enhancement elements, such as Mo, W, Co, Nb and B. However, because of being forged, the known steels cannot contain those elements in large amount, and therefore resistance against higher temperatures cannot be achieved.

Also, in order to detect a material defect with high accuracy by an ultrasonic flaw detection test, a material to be tested is required to have good ultrasonic transmittance. Generally, a casting material has coarse crystal grains with the grain size number of 4 or below, and tends to form a grain-mixed structure because the solidification rate differs depending on the size and thickness. Therefore, the performance of the ultrasonic flaw detection is apt to deteriorate due to attenuation and abnormal refraction of ultrasonic waves, thus resulting in a difficulty in performing the ultrasonic flaw detection in a satisfactory manner. For that reason, a time required for the ultrasonic flaw detection test is extremely prolonged, and a very long time is taken for a periodic inspection. Another problem is that, because of low detection accuracy, the defect size allowable in the operation has to be set to a smaller value, and plant components have to be discarded before reaching their specific lives, whereby effective utilization of the plant components cannot be realized.

An object of the present invention is to provide a pipe for a steam turbine, which is formed of a centrifugal casting material and which can achieve resistance against higher temperatures and can improve reliability of the pipe by employing, as a pipe material, a centrifugal casting material normalized to contain uniform and finer crystal grains, a manufacturing process of the pipe, a main steam pipe and a reheat pipe for a steam turbine, which are manufactured by employing the process, as well as a steam turbine power plant using those pipes.

According to one aspect, the present invention resides in a pipe for a steam turbine wherein the pipe is formed of a centrifugal casting material made of martensitic steel having a columnar structure in the radial direction with the crystal grain size number of 5 or more in a plane perpendicular to the radial direction.

The present invention has been accomplished based on the findings that the centrifugal casting material is equivalent to a forged pipe having the same alloy composition in point of the crystal gain size number in the plane perpendicular to the radial direction and in points of tensile strength and ductility at room temperature and high temperatures, and that the centrifugal casting material has higher creep rupture strength at the longer lapsed-time side and the higher temperature side.

In customary still casting utilizing gravity of a molten metal, shrinkage tends to occur and crystal grains tend to become coarser and mix with each other into the grain size number of 4 or below in average regardless of atmospheric casting or vacuum casting. On the other hand, in centrifugal casting in which a molten metal is poured while rotating a mold and is solidified by utilizing a pressing force caused by a centrifugal force, cracks are less apt to occur even in the case of atmospheric casting, and a structure containing uniform and finer crystal gains can be formed. Further, a columnar crystal grown in the radial direction can be formed. Accordingly, in a component such as a pipe for a steam turbine, particularly a main steam pipe for a steam turbine, which is exposed to higher temperatures and very high inner pressure, the centrifugal casting material having the columnar crystal grown in the radial direction exhibits high creep rupture strength because the columnar crystal develops large deformation resistance against the very high inner pressure. In addition, since the crystal grains form a uniform structure, high performance of the ultrasonic flaw detection can be obtained.

Preferably, the martensitic steel is made of 0.05-0.5% by mass of C, not more than 1.0% of Si, 0.05-1.5% of Mn, 0.01-2.5% of Ni, 8.0-13.0% of Cr, 0.05-2.5% of Mo, not more than 3.0% of W, 0.05-0.35% of V, 0.01-0.5% of Nb, not more than 5% of Co, 0.01-0.1% of N, not more than 0.03% of B, not more than 0.05% of Al, and the balance being unavoidable impurities and iron.

Also, preferably, the martensitic steel is made of 0.07-0.20% by mass of C, 0.2-0.6% of Si, 0.3-0.7% of Mn, 0.2-

0.8% of Ni, 8.0-13.0% of Cr, 0.9-1.8% of Mo, 0.1-0.7% of W, 0.05-0.35% of V, 0.01-0.3% of Nb, 0.01-0.1% of N, 0.005-0.02% of Al, and the balance being unavoidable impurities and iron. Further, preferably, the martensitic steel is made of 0.07-0.20% by mass of C, 0.2-0.6% of Si, 0.3-0.7% of Mn, 0.2-0.8% of Ni, 8.0-13.0% of Cr, 0.5-1.2% of Mo, 1.0-3.0% of W, 0.05-0.35% of V, 0.01-0.3% of Nb, 0.5-2.0% of Co, 0.01-0.1% of N, 0.003-0.02% of B, 0.005-0.02% of Al, and the balance being unavoidable impurities and iron.

The reasons for limitatins on the ranges of material components of the centrifugal casting pipe according to the present invention are as follows.

C is an element required to increase hardenability and to ensure satisfactory strength. If the C content is less than 0.05%, sufficient hardenability cannot be obtained and a soft ferrite structure is produced in the inner peripheral side of cylindrical member where the cooling rate is relatively low. Therefore, sufficient tensile strength and yield strength cannot be obtained. If the C content exceeds 0.5%, toughness is reduced. Thus, the range of the C content is limited to 0.05-0.50%. Preferably, the C content is in the range of 0.10-0.45%, and more preferably, it is in the range of 0.07-0.20% or 0.20-0.35%.

Si serves as a deoxidizer, and Mn serves as a deoxidizer and a desulfurizer. These elements are added in the smelting process of steel and are effective even though a small amount. Also, since addition of Si and Mn promotes flow of molten steel, they are essential elements in casting. Si is preferably not more than 1.0% and more preferably not more than 0.75%. A particularly preferable range of the Si content is 0.2-0.6%.

Addition of Mn in proper amount acts to fixate, in the form of sulfide MnS, a harmful S that is present as an impurity element in steel and deteriorates hot workability. Because of the effect of lessening the harmfulness of S, Mn should be added in proper amount of not less than 0.05%. On the other hand, excessive addition of Mn tends to cause creep brittlement. Therefore, the Mn content is to be not more than 1.5%. In particular, the Mn content is preferably in the range of 0.15-1.2% and more preferably in the range of 0.3-0.7%.

Ni is an element that is essential to improve hardenability and to increase toughness. If the Ni content is less than 0.01%, the effect of increasing toughness is not sufficient. On the other hand, excessive addition of Ni over 2.5% reduces the creep rupture strength. In particular, the Ni content is preferably in the range of 0.2-2.3% and more preferably in the range of 0.2-0.8% or 0.8-2.0%.

Cr is effective in improving hardenability and increasing toughness and strength. Cr is also effective in increasing resistance against corrosion and oxidation in steam. If the Cr content is less than 8.0%, those effects are not sufficient. On the other hand, excessive addition over 13.0% forms the δ-ferrite phase and hence reduces the creep rupture strength and toughness. In particular, the Cr content is preferably in the range of 8.5-12.5% and more preferably in the range of 8.8-12.2%.

Mo is effective in precipitating fine carbides in crystal grains during the tempering, thereby increasing strength at high temperatures and preventing temper brittlement. If the Mo content is less than 0.05%, those effects are not sufficient. On the other hand, excessive addition over 2.5% reduces the toughness. In particular, at temperature of about 600° C., it is preferable that the Mo content be set to a relatively high level in the range of 0.9-1.8%, while the W content (described later) be set to a relatively low level in the range of 0.1-0.7%. Also, at temperature of about 630° C., it is preferable that the Mo content be set to a relatively low level in the range of 0.5-1.2%, while the W content (described later) be set to a relatively high level in the range of 1.0-3.0%.

Similarly to Mo, W is effective in precipitating fine carbides, thereby increasing strength at high temperatures and preventing temper brittlement. Excessive addition of W over 3.0% reduces the toughness. In particular, the W content is preferably set depending on the temperature in use, as described above.

V is effective in precipitating fine carbides in crystal grains during the tempering, thereby increasing strength at high temperatures and toughness. If the V content is less than 0.05%, those effects are not sufficient. On the other hand, excessive addition over 0.35% leads to saturation of the effects. In particular, the V content is preferably in the range of 0.15-0.33% and more preferably in the range of 0.20-0.30%.

Similarly to V, Nb is effective in precipitating fine carbides, thereby increasing strength at high temperatures and toughness. It was proved from experiments using a small steel ingot that the effect of greatly increasing the strength could be obtained with addition of Nb in combination with V. The following was also proved from the experiments. If the Nb content is less than 0.01%, those effects are not sufficient. On the other hand, excessive addition over 0.5% leads to saturation of the effects and invites deterioration of the toughness. In particular, the Nb content is preferably in the range of 0.04-0.45% and more preferably in the range of 0.06-0.15% or 0.15-0.4%.

Addition of Co increases strength at high temperatures and toughness. However, excessive addition over 5% reduces the toughness. In particular, the Co content is preferably not more than 4% and more preferably not more than 3%. At the above-mentioned temperature of about 630° C., Co is preferably added in the range of 0.5-2.0%.

N is effective in increasing the creep rupture strength and preventing generation of the δ-ferrite phase. If the N content is less than 0.01%, those effects are not sufficient. On the other hand, excessive addition over 0.1% reduces not only the toughness, but also the creep rupture strength. In particular, the N content is preferably in the range of 0.02-0.09% and more preferably in the range of 0.03-0.08%.

B acts to reinforce the grain boundary and is effective in preventing aggregation of carbides into coarser grains and increasing strength at high temperatures. However, excessive addition of B over 0.03% reduces the toughness. In particular, the B content is preferably not more than 0.020% and more preferably not more than 0.015%.

Al is added as a deoxidizer, but it acts as a strong nitride-forming element to fixate N that is effective in suppressing creep, thus reducing the creep rupture strength in a high temperature range over 550° C. Also, Al promotes precipitation of the Laves phase, i.e., a brittle intermetallic compound made of primarily W and Mo, and hence reduces the creep rupture strength. For those reasons, an upper limit of the Al content is set to 0.05%. In particular, the Al content is preferably not more than 0.04% and more preferably not more than 0.35%.

Reduction in amounts of P and S is effective in increasing the creep rupture strength and toughness at low temperatures. Therefore, the P and S contents are desired to be kept as low as possible. From the viewpoint of increasing the toughness at low temperatures, the P content is preferably not more than 0.020% and the S content is preferably not more than 0.020%. In particular, the P and S contents are each preferably not more than 0.015% and more preferably not more than 0.010%.

Reduction in contents of Sb, Sn and As is also effective in increasing the toughness at low temperatures. Therefore, the Sb, Sn and As contents are desired to be kept as low as possible. In consideration of a current level of the steel making technology, however, the Sb content is preferably not more than 0.0015%, the Sn content is preferably not more than 0.01%, and the As content is preferably not more than 0.02%. More preferably, the Sb content is not more than 0.0010%, the Sn content is not more than 0.005%, and the As content is not more than 0.01%.

In the case of forged steel, it is required to hold the amounts of added C, Mo, W, Nb and B to be low in order to prevent cracks in the forging process. In the case of cast steel, however, because hot working represented by forging is not required, upper limits in added amounts of those elements can be increased. Also, in the case of customary casting, component segregation tends to occur because of the presence of limitation in the cooling rate. In the case of centrifugal casting, however, the solidification rate can be increased and the component segregation is less apt to occur. It is hence possible to obtain higher-alloy steel and to realize adaptation for higher temperatures.

The centrifugal casting material according to the present invention has smooth-specimen creep rupture strength of not less than 95 MPa, preferably not less than 98.5 MPa, at 600° C. and 100,000 hours, and tensile strength of not less than 570 MPa, preferably not less than 590 MPa, at room temperature. Further, preferably, the centrifugal casting material has a flange integrally formed at one end at least.

According to another aspect, the present invention resides in a manufacturing process of a pipe for a steam turbine, the process comprising the steps of preparing ferrite-based molten steel by cradle refining; pouring the ferrite-based molten steel into a rotating cylindrical mold including a ceramic wash formed on an inner surface of the mold, thereby to perform centrifugal casting; and forming a columnar structure in the radial direction with the crystal grain size number of 5 or more in a plane perpendicular to the radial direction.

According to still another aspect, the present invention resides in a manufacturing process of the pipe for the steam turbine, the process comprising the steps of preparing a centrifugal casting material made of ferrite-based steel having a columnar structure in the radial direction with the crystal grain size number of 5 or more in a plane perpendicular to the radial direction; rapidly cooling the centrifugal casting material after heating and holding the centrifugal casting material to and at austenizing temperature; and tempering the rapidly cooled centrifugal casting material in two stages, thereby forming a martensite structure.

Preferably, the austenizing temperature is in the range of 1000-1100° C., the rapid cooling is performed by any of air cooling and air-blast cooling, and temperature of the two-stage tempering is in the range of 550-780° C., the cooling in the first-stage tempering being performed by air cooling and the cooling in the second-stage tempering being performed by furnace cooling.

The centrifugal casting material used in the present invention is able to form finer crystal grains and to realize higher strength with reinforcement obtained by the finer crystal grains.

According to still another aspect, the present invention resides in a main steam pipe for a steam turbine, wherein a main steam pipe for feeding high-temperature and high-pressure main steam to a high-pressure steam turbine or a high- and medium-pressure integral steam turbine is formed of one of the above-described pipe for the steam turbine and the pipe for the steam turbine manufactured by the above-described manufacturing process of the pipe for the steam turbine.

According to still another aspect, the present invention resides in a reheat pipe for a steam turbine, wherein a reheat pipe for reheating steam discharged from a high-pressure steam turbine and feeding the reheated steam to a medium-pressure steam turbine or a reheat pipe for reheating steam discharged from a high-pressure section of a high- and medium-pressure integral steam turbine and feeding the reheated steam to a medium-pressure section of the high- and medium-pressure integral steam turbine is formed of one of the above-described pipe for the steam turbine and the pipe for the steam turbine manufactured by the above-described manufacturing process of the pipe for the steam turbine.

According to still another aspect, the present invention resides in a steam turbine power plant comprising a high-pressure steam turbine, a medium-pressure steam turbine and a single low-pressure steam turbine, or comprising a high-pressure steam turbine, a medium-pressure steam turbine and two low-pressure steam turbines coupled to each other in tandem, wherein at least a main steam pipe for feeding high-temperature and high-pressure main steam to the high-pressure steam turbine is formed of the above-described main steam pipe for the steam, or a reheat pipe for reheating steam discharged from the high-pressure steam turbine and feeding the reheated steam to the medium-pressure steam turbine is formed of the above-described reheat pipe for the steam turbine, the main steam pipe being preferably joined by welding to an external casing of the high-pressure steam turbine through an elbow pipe.

According to still another aspect, the present invention resides in a steam turbine power plant comprising a high- and medium-pressure integral steam turbine and a single low-pressure steam turbine, or comprising a high- and medium-pressure integral steam turbine and two low-pressure steam turbines coupled to each other in tandem, wherein at least a main steam pipe for feeding high-temperature and high-pressure main steam to the high- and medium-pressure integral steam turbine is formed of the above-described main steam pipe for the steam turbine, or a reheat pipe for reheating steam discharged from a high-pressure section of the high- and medium-pressure integral steam turbine and feeding the reheated steam to a medium-pressure section of the high- and medium-pressure integral steam turbine is formed of the above-described reheat pipe for the steam turbine, the main steam pipe being preferably joined by welding to an external casing of the high- and medium-pressure integral steam turbine through an elbow pipe.

Preferably, the outer casing is manufactured by cast steel containing 0.07-0.20% by mass of C, 0.05-0.6% of Si, 0.1-1.0% of Mn, 0.1-0.5% of Ni, 1.0-2.5% of Cr, 0.5-1.5% of Mo, and 0.1-0.35% of V, as well as at least one of not more than 0.025% of Al, 0.0005-0.004% of B, and 0.05-0.2% of Ti, the cast steel having a totally tempered bainite structure. In particular, the cast steel preferably contains 0.10-0.18% of C, 0.20-0.60% of Si, 0.20-0.50% of Mn, 0.1-0.5% of Ni, 1.0-1.5% of Cr, 0.9-1.2% of Mo, 0.2-0.3% of V, 0.001-0.005% of Al, 0.045-0.010% of Ti, and 0.0005-0.0020% of B. More preferably, a Ti/Al ratio is in the range of 0.5-10.

Within the outer casing, an inner casing is disposed which is made of martensitic cast steel containing 0.06-0.16% by mass of C, not more than 0.4% of Si, not more than i% of Mn, 8-12% of Cr, 0.2-0.9% of Ni, 0.05-0.3% of V, 0.01-0.15% of Nb, 0.01-0.08% of N, not more than 1% of Mo, 1-3% of W, and not more than 0.003% of B. More preferably, the inner casing is made of martensitic cast steel containing 0.09-0.14% by mass of C, not more than 0.3% of Si, 0.40-0.70% of Mn, 8-10% of Cr, 0.4-0.7% of Ni, 0.15-0.25% of V, 0.04-0.08% of Nb, 0.02-0.06% of N, 0.40-0.80% of Mo, 1.4-1.9% of W, and 0.001-0.0025% of B, the balance being Fe and unavoidable impurities. In addition, the martensitic cast steel preferably contains at least one of not more than 0.15% of Ta and not more than 0.1% of Zr.

The cast steel forming the inner casing has creep rupture strength of not less than 9 kgf/mm$^2$ at 620° C. and 100,000 hours and impact absorption energy of not less than 1 kgf-m at room temperature, and exhibits good weldability. In order to ensure higher reliability, the cast steel preferably has creep rupture strength of not less than 10 kgf/mm$^2$ at 625° C. and 100,000 hours and impact absorption energy of not less than 2 kgf-m at room temperature.

A manufacturing process of the outer and inner casings according to the present invention preferably comprises the steps of smelting alloy materials having the above-described target composition of any of the cast steels, performing ladle refining of the alloy materials, and pouring the refined alloy materials in a sand mold for casting. After the pouring and casting, preferably, the cast steel is subjected to annealing at 1000-1150° C., to normalizing heat treatment in which the steel is heated to 1000-1100° C. and then rapidly cooled, and then to tempering in two stages at 550-750° C. and 670-770° C.

Thus, according to the present invention, the pipe for the steam turbine is obtained, which is formed of a centrifugal casting material and which can achieve resistance against higher temperatures and can improve reliability of the pipe by employing, as a pipe material, the centrifugal casting material normalized to contain uniform and finer crystal grains. Further, the present invention provides the manufacturing process of the pipe, the main steam pipe and the reheat pipe for the steam turbine, which are manufactured by employing the process, as well as the steam turbine power plant using those pipes.

DESCRIPTION OF THE PREFERRED EMBODIMENTS

Figure 1:
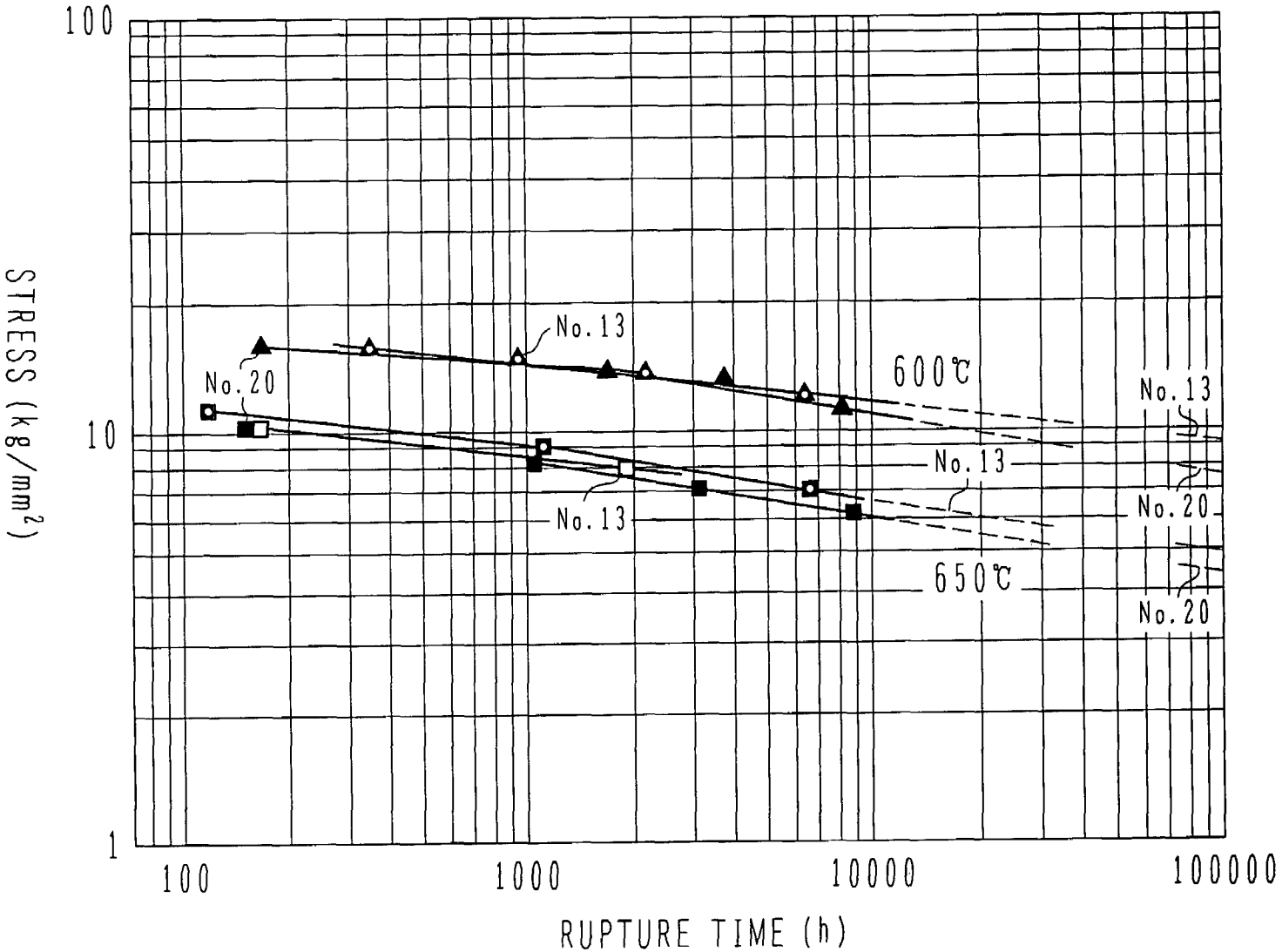
FIG. 1 is a graph showing the relationship between stress and rupture time.

The best mode for carrying out the present invention will be described in detail below in connection with specific embodiments, but it is to be noted that the present invention is not limited to the following embodiments.

[First Embodiment]

In this first embodiment, a centrifugal casting pipe is manufactured through the steps of rotating a rotatable mold at about 800 rpm, pouring molten steel prepared in a ladle into the rotatable mold, and solidifying the poured steel. Centrifugal casting pipes having various diameters, wall thicknesses and lengths can be obtained depending on the rotational speed, capacity and size of the mold. The mold is made of forged carbon steel, i.e., a material endurable against an abrupt thermal impact, and is coated over its inner surface with a mold wash made of ceramic powder. The crystal grain size of the manufactured centrifugal casting pipe can be controlled depending on the kind and thickness of the mold wash material. In this first embodiment, a centrifugal casting pipe having dimensions of 450 mm (outer diameter)×250 mm (inner diameter)×1000 mm (length) was obtained.

Table 1, given below, lists chemical composition (% by mass) of the centrifugal casting pipe according to the present invention, a forged pipe, and a customary casting pipe. Specimens were prepared through the steps of smelting respective steels in a high-frequency smelting furnace, and forming the centrifugal casting pipe by pouring the molten steel into the rotating mold, or forming the forged pipe by hot forging, or forming the customary casting pipe by customary casting.

Specimens Nos. 1-13 each represent the centrifugal casting pipe (made of a centrifugal casting material) according to the present invention, a specimen No. 20 represents the forged pipe for comparison, and specimens Nos. 21-24 each represent the conventional casting pipe (made of a conventional casting material) for comparison. Each specimen was subjected to hardening and two-stage tempering. The hardening was carried out by heating and holding the pipe at 1050° C. for 10 minutes and cooling it by air cooling. The tempering was carried out in two stages, i.e., a first stage of heating and holding the pipe at 770° C. for 1 hour and cooling it by air cooling, and a second stage of heating and holding the pipe at 740° C. for 1 hour and cooling it in the furnace.

TABLE 1

| No. | C | Si | Mn | P | S | Ni | Cr | Mo | W | Co | Nb | V | N | B | Al | Fe |
|---|---|---|---|---|---|---|---|---|---|---|---|---|---|---|---|---|
| 1 | 0.12 | 0.30 | 0.46 | 0.005 | 0.004 | 0.5 | 10.8 | 1.3 | 0.3 | — | 0.06 | 0.20 | 0.045 | — | 0.012 | balance |
| 2 | 0.12 | 0.34 | 0.48 | 0.005 | 0.004 | 0.6 | 10.7 | 1.4 | 0.4 | 1.2 | 0.07 | 0.21 | 0.045 | — | 0.008 | balance |
| 3 | 0.10 | 0.29 | 0.61 | 0.004 | 0.004 | 0.5 | 11.0 | 0.8 | 2.1 | 1.1 | 0.08 | 0.25 | 0.021 | 0.008 | 0.007 | balance |
| 4 | 0.13 | 0.28 | 0.54 | 0.005 | 0.004 | 0.2 | 10.2 | 0.3 | 2.5 | 2.5 | 0.07 | 0.21 | 0.022 | 0.012 | 0.004 | balance |
| 5 | 0.25 | 0.42 | 0.44 | 0.005 | 0.004 | 1.8 | 11.2 | 2.1 | 0.3 | 2.4 | 0.15 | 0.25 | 0.062 | 0.013 | 0.003 | balance |
| 6 | 0.35 | 0.54 | 0.46 | 0.004 | 0.005 | 2.2 | 11.5 | 2.5 | — | — | 0.20 | 0.23 | 0.075 | — | 0.003 | balance |
| 7 | 0.15 | 0.32 | 0.45 | 0.005 | 0.005 | 2.1 | 11.0 | 2.1 | — | — | 0.12 | 0.25 | 0.065 | — | 0.002 | balance |
| 8 | 0.15 | 0.45 | 0.52 | 0.005 | 0.004 | 0.5 | 8.7 | 1.3 | 0.3 | — | 0.06 | 0.20 | 0.043 | — | 0.040 | balance |
| 9 | 0.12 | 0.44 | 0.41 | 0.004 | 0.004 | 0.2 | 8.6 | 0.3 | 2.6 | 2.5 | 0.07 | 0.25 | 0.025 | 0.012 | 0.008 | balance |
| 10 | 0.11 | 0.48 | 0.51 | 0.005 | 0.005 | 0.5 | 8.4 | 0.8 | 2.2 | — | 0.07 | 0.19 | 0.022 | 0.009 | 0.024 | balance |
| 11 | 0.36 | 0.47 | 0.50 | 0.005 | 0.005 | 0.8 | 9.2 | 0.8 | 2.3 | 1.5 | 0.42 | 0.25 | 0.051 | — | 0.035 | balance |
| 12 | 0.11 | 0.35 | 0.48 | 0.005 | 0.004 | 0.5 | 8.5 | 0.9 | 2.1 | 1.2 | 0.07 | 0.25 | 0.028 | 0.002 | 0.024 | balance |
| 13 | 0.08 | 0.34 | 0.42 | 0.011 | 0.011 | 0.35 | 8.97 | 0.97 | — | — | 0.11 | 0.24 | 0.044 | — | 0.030 | balance |
| 20 | 0.08 | 0.34 | 0.49 | 0.005 | 0.004 | 0.09 | 8.3 | 0.9 | — | — | 0.07 | 0.23 | 0.059 | — | 0.011 | balance |

TABLE 1-continued

| No. | C | Si | Mn | P | S | Ni | Cr | Mo | W | Co | Nb | V | N | B | Al | Fe |
|---|---|---|---|---|---|---|---|---|---|---|---|---|---|---|---|---|
| 21 | 0.08 | 0.34 | 0.49 | 0.005 | 0.004 | 0.09 | 8.3 | 0.9 | — | — | 0.10 | 0.25 | 0.045 | — | 0.011 | balance |
| 22 | 0.10 | 0.24 | 0.44 | 0.005 | 0.001 | 0.04 | 8.7 | 0.8 | 2.1 | — | 0.11 | 0.24 | 0.044 | — | 0.014 | balance |
| 23 | 0.12 | 0.34 | 0.41 | 0.005 | 0.005 | 0.25 | 11.2 | 0.5 | 2.1 | — | 0.08 | 0.22 | 0.055 | 0.0008 | 0.025 | balance |
| 24 | 0.11 | 0.22 | 0.51 | 0.004 | 0.004 | 0.20 | 10.5 | 0.21 | 2.6 | 2.5 | 0.06 | 0.25 | 0.020 | 0.0120 | 0.008 | balance |

Table 2, given below, shows the results of tensile tests of the centrifugal casting pipes according to the present invention, the forged pipe, and the casting pipes, and creep rupture tests at 600° C. and 100,000 hours. The centrifugal casting pipes according to the present invention were each rapidly cooled from an outer peripheral surface of the mold, but they had a columnar structure grown in the radial direction from the outer peripheral surface side toward the inner peripheral surface side and the crystal grain size number of 6.8-9.5 in a plane perpendicular to the radial direction, as shown in Table 2. In other words, crystal grains of the centrifugal casting pipe were much finer than those of the customary casting pipe with the crystal grain size number of 1.8-3.3, and their sizes were comparable to those of crystal grains of the forged pipe having the same alloy composition and the crystal grain size number of 8.0. Further, the crystal grains of the casting pipes were coarse and mixed with each other. In addition, the centrifugal casting pipes according to the present invention had the average crystal grain sizes of about 15-35 μm in the plane perpendicular to the radial direction. Because the centrifugal casting pipe had a relatively large wall thickness, the columnar structure was not in the straight bar-like form, but in the mutually tangled form. For that reason, the centrifugal casting pipes had high strength at high temperatures as described above.

TABLE 2

| No. | Crystal Grain Size No. | Tensile Strength (MPa) | Elongation (%) | Reduction of Area (%) | Creep Rupture Strength* (MPa) |
|---|---|---|---|---|---|
| 1 | 7.5 | 725 | 21 | 66 | 102.5 |
| 2 | 8.8 | 730 | 20 | 59 | 101.1 |
| 3 | 9.2 | 755 | 19 | 58 | 101.5 |
| 4 | 8.7 | 764 | 20 | 61 | 98.6 |
| 5 | 7.8 | 784 | 22 | 63 | 100.6 |
| 6 | 8.5 | 721 | 20 | 57 | 99.8 |
| 7 | 6.8 | 681 | 23 | 70 | 98.2 |
| 8 | 8.5 | 694 | 20 | 56 | 98.9 |
| 9 | 7.2 | 674 | 22 | 64 | 99.8 |
| 10 | 8.4 | 682 | 22 | 66 | 99.7 |
| 11 | 8.6 | 666 | 22 | 64 | 99.9 |
| 12 | 9.5 | 715 | 21 | 62 | 100.4 |
| 13 | 7.8 | 660 | 25 | 68 | 88.8 |
| 20 | 8.0 | 676 | 25 | 75 | 74.6 |
| 21 | 2.2 | 582 | 17 | 48 | 85.6 |
| 22 | 3.3 | 594 | 17 | 52 | 92.6 |
| 23 | 1.8 | 542 | 16 | 44 | 74.1 |
| 24 | 2.5 | 522 | 18 | 46 | 82.5 |

*rupture strength at 600° C. and $10^5$ hours

Also, as shown in Table 2, the centrifugal casting s according to the present invention had tensile strength of 660-784 MPa that was higher than 522-594 MPa he casting pipe and that was comparable to or higher 676 MPa of the forged pipe. Further, the centrifugal casting pipes according to the present invention had tensile elongation rates of 19-25% that were higher than 16-18% he casting pipe, and had reductions of area of 56-70% were higher than 44-52% of the casting pipe and were comparable to 25% of the forged pipe.

The creep rupture strength of the centrifugal casting pipes according to the present invention was in the range of 88.8-102.5 MPa that was higher than 74.1-92.6 MPa of the casting pipe for the same alloy composition and was also higher than 74.6 MPa of the forged pipe having the same alloy composition.

FIG. 1 shows creep rupture curves at 600° C. obtained for the centrifugal casting pipe No. 13 according to the present invention and the forged pipe No. 20. The centrifugal casting pipe No. 13 and the forged pipe No. 20 have substantially the same alloy composition. As seen from FIG. 1, in comparison with the forged pipe No. 20, the centrifugal casting pipe No. 13 according to the present invention has substantially the same creep rupture strength until 4000 hours at 600° C. After 4000 hours, however, the centrifugal casting pipe No. 13 according to the present invention has a smaller gradient and exhibits higher creep rupture strength at the longer lapsed-time side. Also, it is seen that, at 650° C., the centrifugal casting pipe No. 13 according to the present invention exhibits higher creep rupture strength than the forged pipe No. 20 at each of the shorter lapsed-time side and the longer lapsed-time side.

Figure 2:
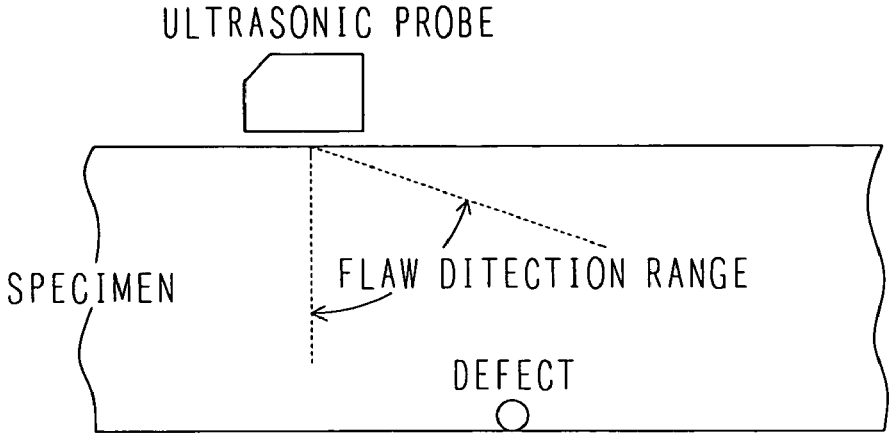
FIG. 2 is a schematic view showing a manner of performing ultrasonic flaw detection.
Figure 3A:
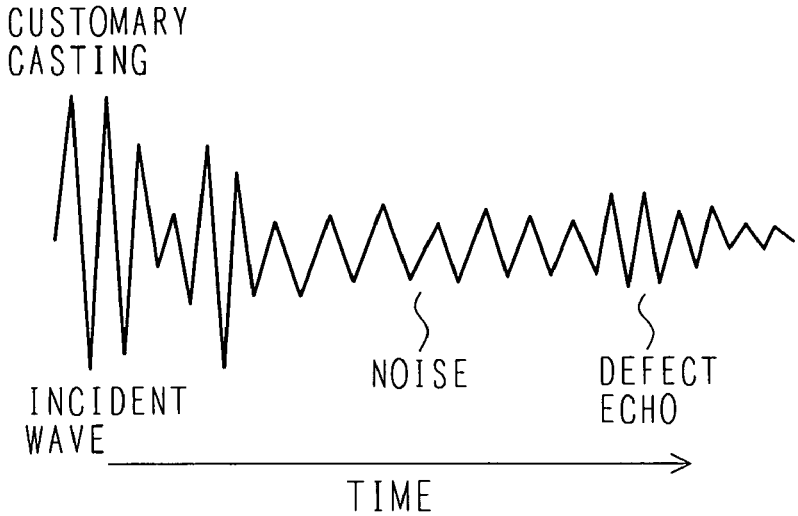
FIGS. 3A and 3B are each a chart showing an ultrasonic reflection echo.
Figure 3B:
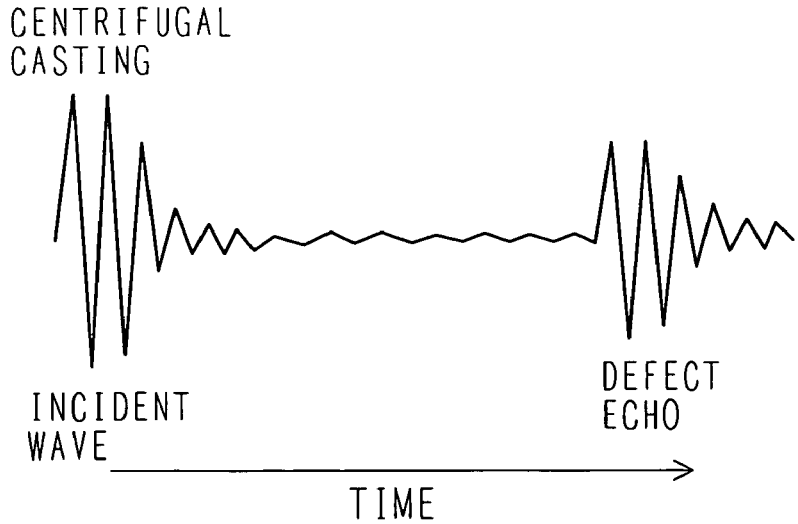

FIG. 2 is a sectional view showing the positional relationship among an ultrasonic probe relative to a specimen, a flaw detection region, and a defect in ultrasonic flaw detection. FIGS. 3A and 3B are a chart showing a reflection echo in the ultrasonic flaw detection for the known cast steel, and a chart showing a reflection echo in the ultrasonic flaw detection for the centrifugal casting steel used in the present invention, respectively.

Specimens were prepared as a casting material (FIG. 3A) made of 9%-Cr cast steel (having the crystal grain size numbers of 1-4 and the average grain size number of 2.8) and as a centrifugal casting material (FIG. 3B) made of 9%-Cr cast steel (having the crystal grain size numbers of 7-8 and the average grain size number of 7.6), which was manufactured by the centrifugal casting. In each of the specimens, a similar artificial defect was formed at the bottom surface of a target part, and accuracy of the ultrasonic flaw detection was compared between the specimens. The operating speed of the ultrasonic probe 2 using a ceramic oscillator of barium titanate was set to a range not beyond 150 mm/sec, the flaw detection frequency was set to 2 MHz, and glycerin was used as a contact medium.

In the casting material (FIG. 3A) having the crystal grain size numbers of 1-4, because of a grain mixed structure containing coarse grains and fine grains in a mixed manner, sufficient detection accuracy could not obtained due to the presence of noise caused by abnormal reflection and an amplitude reduction of the defect echo caused by lowering of penetration power. On the other hand, in the centrifugal casting material (FIG. 3B) having the crystal grain size numbers of 7-8, because a structure made up of only fine crystal grains and having a uniform grain size was formed, noise was not generated and a reduction in amplitude of the defect echo did not occur, whereby sufficient detection accuracy was obtained. Also, it was confirmed in an ultrasonic inspection of the centrifugal casting material that the defect could be detected with high detection accuracy due to soundness of the structure.

With this first embodiment, it is possible to achieve high defect detection accuracy in the ultrasonic flaw detection, to facilitate periodic inspection, and to improve reliability of the pipe.

As described above, the centrifugal casting material according to the present invention has a uniform fine grain structure and, assuming substantially the same chemical composition for comparison, it is superior not only in strength, ductility and toughness, but also in tensile strength at room temperature and creep rupture strength at 100,000 hours to the casting material. Thus, the centrifugal casting material has all of characteristics required as a pipe for a steam turbine.

Consequently, according to this first embodiment, by employing, as a pipe material, the centrifugal casting material normalized to contain uniform and finer crystal grains, the pipe for the steam turbine is obtained which is formed of the centrifugal casting pipe and which can achieve resistance against higher temperatures and can improve reliability of the pipe.

(Second Embodiment)

Table 3, given below, shows materials selected for a high- and medium-pressure integral steam turbine at 600° C. and the construction of a power plant employing the high- and medium-pressure integral steam turbine. As shown in Table 3, in the arrangement (A), electric power is generated by a generator G rotated by the high- and medium-pressure integral steam turbine and a single low-pressure steam turbine (LP) directly coupled to a rotor shaft of the former. In the arrangement (B), electric power is generated by a generator G rotated by the high- and medium-pressure integral rotor shaft and two low-pressure steam turbines (LP) directly coupled to the former. Further, Table 3 shows the structure of an initial-stage rotor blade in the high-pressure side, the material of a final-stage rotor blade of the low-pressure steam turbine (LP), the material of the high- and medium-pressure integral rotor shaft, etc.

TABLE 3

| | |
|---|---|
| Turbine type | TCDF-43 |
| Rotational speed | 3000/3000 RPM |
| Steam condition | 25 MPa-600° C./600° C. |
| Turbine arrangement | |
| A | 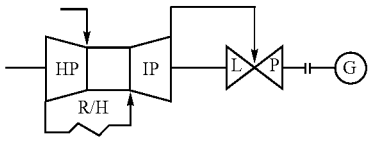  |
| B | 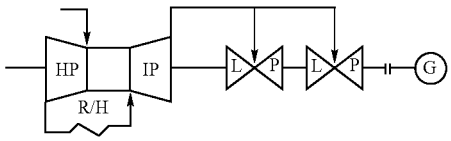  |
| Structure of initial-stage blade | 2-tenon saddle-shaped dovetail blade |
| Final-stage blade | 43-inch blade of titanium alloy or high-strength 12-Cr forged steel |
| Body of main steam check valve | high-strength 12-Cr forged steel |
| Body of steam adjusting valve | |
| High- and medium-pressure rotor | high-strength 12-Cr forged steel |
| Low-pressure rotor | 3.5 Ni-Cr-Mo-V forged steel |
| Rotor blade in high-temperature section | initial stage high-strength 12-Cr forged steel |
| High- and medium-pressure compartment | |
| inner side | high-strength 9-Cr forged steel |
| outer side | high-strength Cr-Mo-V-B cast steel |

Figure 4:
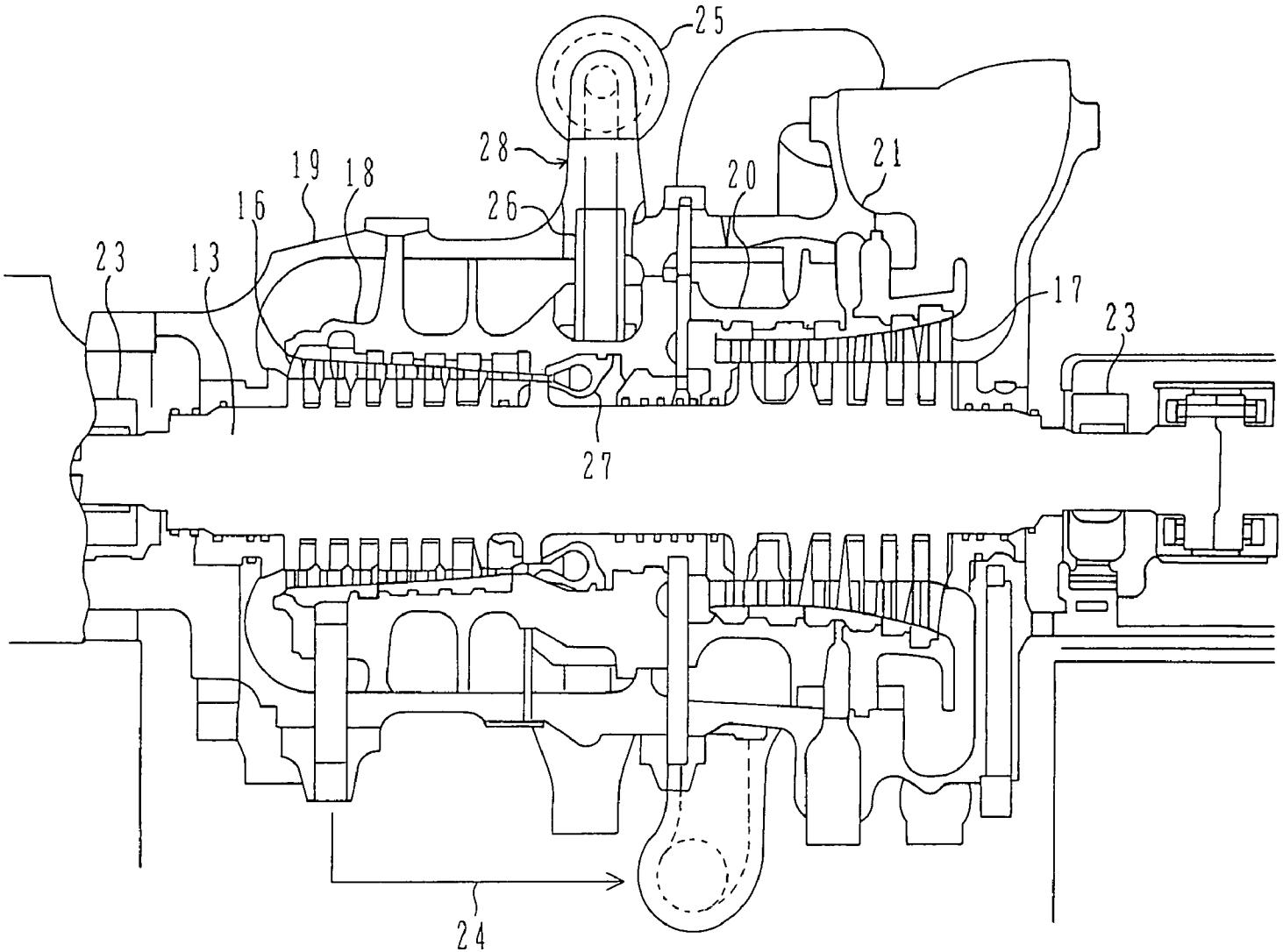
FIG. 4 is an overall sectional view of a high- and medium-pressure integral steam turbine according to the present invention.

FIG. 4 is an overall sectional view showing one example of the high- and medium-pressure integral steam turbine with output power of 600 MW to which is applied the main steam pipe manufactured by the centrifugal casting. A high-pressure steam turbine (HP) comprises an inner casing 18, an outer casing 19 disposed on the outer side of the inner casing 18, and high-pressure rotor blades 16. A medium (intermediate)-pressure steam turbine (IP) comprises an inner casing 20, an outer casing 21 disposed on the outer side of the inner casing 20, and medium-pressure rotor blades 17. Further, there is a high- and medium-pressure integral rotor shaft 13 to which those rotor blades are mounted.

High-temperature and high-pressure main steam is obtained by a boiler, and a main steam pipe on the boiler side is connected to a flange 25. The main steam passes through a main steam inlet of the high- and medium-pressure integral steam turbine through a main steam pipe 28 on the side of the high- and medium-pressure integral steam turbine and is introduced to an initial stage of the high-pressure rotor blades 16 through a nozzle box 27. The high- and medium-pressure integral steam turbine includes 8 stages of high-pressure rotor blades 16 on the high-pressure side, i.e., in a left half as viewed in the drawing, and 6 stages of rotor blades 17 on the medium-pressure side, i.e., in a right half as viewed in the drawing. Stator blades are provided respectively corresponding to the rotor blades. The rotor blades are each of the double-tenon dovetail type having the shape of a saddle or Japanese clog. The initial-stage blade length in the high-pressure side is about 40 mm, and the initial-stage blade length in the medium-pressure side is about 100 mm.

The medium-pressure steam turbine heats again the steam discharged from the high-pressure steam turbine to 600° C. by a reheater (R/H) and rotates the generator G by the heated steam in cooperation with the high-pressure steam turbine. The medium-pressure steam turbine is rotated at a rotational speed of 3000 RPM.

Figure 5:
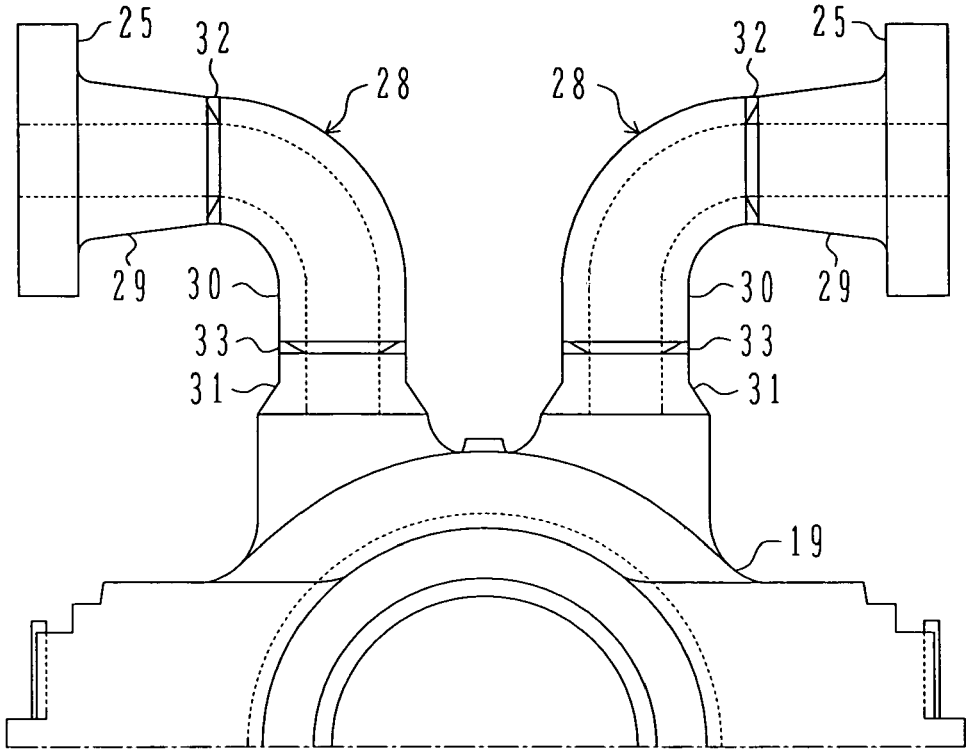
FIG. 5 is a left side view of the steam turbine shown in FIG. 4.

FIG. 5 is a left side view of the high- and medium-pressure integral steam turbine shown in FIG. 4, the view illustrating a partial structure of one example of that steam turbine. As shown in FIG. 5, the high-temperature and high-pressure main steam is supplied through each main steam pipe 28 of the high- and medium-pressure integral steam turbine. In this second embodiment, the main steam pipe 28 comprises a flange 25, a straight portion 29, and an elbow 30. The flange 25 and the straight portion 29 are formed in an integral structure by centrifugal casting. The straight portion 29 and the elbow 30 have respective open ends and are integrally joined to each other at a weld 32 formed by build-up welding. Further, the elbow 30 of the main steam pipe 28 and a joint portion 31 of the outer casing 19 have respective open ends and are integrally joined to each other at a weld 33 formed by build-up welding.

Figure 6:
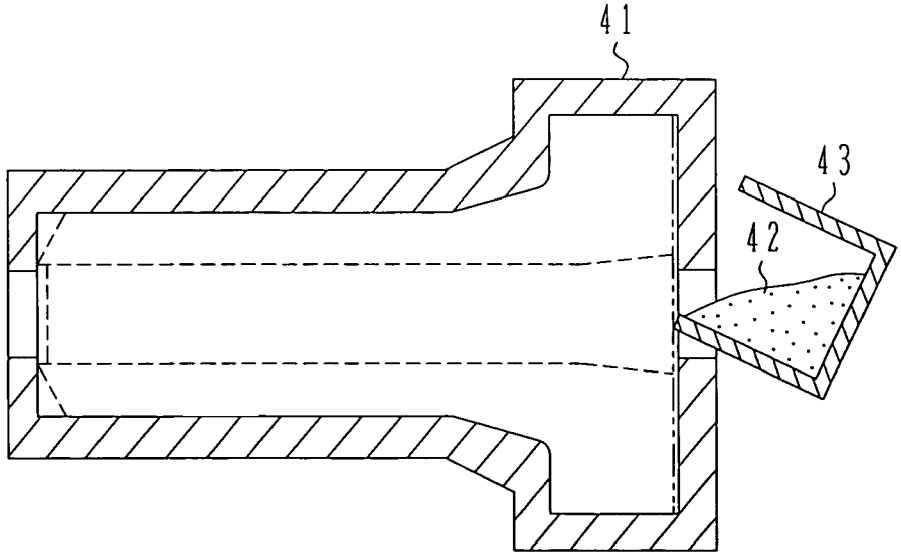
FIG. 6 is a sectional view of a centrifugal casting apparatus for casting an elbow pipe according to the present invention.

FIG. 6 is a sectional view of a centrifugal casting apparatus for casting the flange and the straight portion of the main steam pipe into an integral structure by centrifugal casting. As shown in FIG. 6, a rotatable mold 41 is a metallic mold having a section to form the flange 25 and a section to form the straight portion 29. While the rotatable mold 41 is rotated at a predetermined rotational speed, molten steel 42 prepared in a lade 43 is poured into the rotatable mold 41 and then solidified, whereby a centrifugal casting pipe having the flange 25 is obtained. Centrifugal casting pipes having various diameters, wall thicknesses and lengths can be obtained depending on the rotational speed, capacity and size of the mold. The mold is made of forged carbon steel, i.e., a material endurable against an abrupt thermal impact, and is coated over its inner surface with a mold wash made of ceramic powder. The crystal grain size of the manufactured centrifugal casting pipe can be controlled depending on the kind and thickness of the mold wash material. The straight portion 29 has the outer diameter and the inner diameter mentioned in the first embodiment, and has a length of about 1 m.

The flange 25 and the straight portion 29 of the main steam pipe 28 in this second embodiment are manufactured by using the composition of the specimen No. 8 in Table 1, described above in the first embodiment. The straight portion 29 has a columnar structure in the radial direction and, as shown in Table 2, has the tensile strength of 694 MPa at room temperature and the creep rupture strength of 98.9 MPa at 600° C. and 100,000 hours. A defect size detected by the ultrasonic flaw detection carried out before use is 1.4 mm in equivalent diameter at maximum. Thus, the detected defect size is much smaller than the maximum allowable defect defined from the viewpoint of rupture dynamics, and the practical use of 1 million hours or longer is enabled.

The elbow 30 is formed of the forged pipe No. 20 shown in Table 1 and is integrally joined to the straight portion 29 at their open ends by build-up welding using a welding material of a eutectic alloy, whereby the main steam pipe 28 is formed. Also, the main steam pipe 28 is joined, by build-up welding, to the outer casing 19 made of martensitic cast steel containing 0.06-0.2% by mass of C, 1.5-2.5% of Cr, 0.5-1.5% of Mo, 0.05-0.3% of V, and 0.005-0.03% of B in accordance with TIG welding using a welding wire which is made of the same martensitic cast steel except for not containing B.

With this second embodiment, by using the centrifugal casting pipe having high flaw detection accuracy in the ultrasonic flaw detection test, it is possible to reduce the inspection cost, to prolong the component life, and to improve reliability of the plant.

Further, as seen from Table 3, the plant includes a reheat pipe 24, shown in FIG. 4, for reheating (R/H) and feeding the steam discharged from a high-pressure section of the high- and medium-pressure integral steam turbine to a medium-pressure section of the high- and medium-pressure integral steam turbine. In this second embodiment, like the above-described main steam pipe 28, the reheat pipe 24 can also be formed of a centrifugal casting pipe which is manufactured from cast steel having the same alloy composition by the centrifugal casting and is subjected to heat treatment in a similar manner. As a result, a steam turbine power plant having higher reliability can be realized.

Moreover, with this second embodiment, a main steam pipe for feeding the high-temperature and high-pressure main steam until the inlet of the high- and medium-pressure integral steam turbine on the boiler side can be entirely formed as a pipe formed with flanges or no flanges by using a welding material of a eutectic alloy. Such a main steam pipe can be manufactured with the outer diameter and the inner diameter, mentioned in the first embodiment, and a length of 1 m or more.

Thus, according to this second embodiment, by employing, as a pipe material, the centrifugal casting material normalized to contain uniform and finer crystal grains, the steam turbine power plant is obtained which can achieve resistance against higher temperatures and can improve reliability of the pipe.

(Third Embodiment)

This third embodiment is directed to the case of using the high-pressure steam turbine and the medium-pressure steam turbine instead of the high- and medium-pressure integral steam turbine. In that case, the integral structure of (HP) and (IP) shown in (B) of Table 3 is replaced with the high-pressure steam turbine and the medium-pressure steam turbine, thereby constituting a cross compound structure (CC4F). The generator G is rotated by not only the high-pressure steam turbine and the medium-pressure steam turbine, but also by two low-pressure steam turbines.

Each of the high-pressure steam turbine and the medium-pressure steam turbine has an outer casing and an inner casing, which are made of the same materials as those used in the second embodiment. The high-temperature and high-pressure main steam obtained by the boiler passes through main steam pipes and is introduced to an initial-stage rotor blade through a nozzle box from an elbow which is joined to the outer casing of the high-pressure steam turbine by welding in a similar manner to that described above. The initial-stage rotor blade is of a multiple-flux structure, and other rotor blades in eight stages are disposed on one side. Stator blades are provided respectively corresponding to the rotor blades.

Also in this third embodiment, a flange and a straight portion of the main steam pipe are manufactured by the centrifugal casting as in the second embodiment. Further, the main steam pipe is joined by welding to an elbow, which is formed of a forged pipe having the same crystal structure, mechanical characteristics, and alloy composition as those described above, for connection to the outer casing. In this third embodiment, therefore, by employing, as a pipe material, the centrifugal casting material normalized to contain uniform and finer crystal grains, the steam turbine power plant is obtained which can achieve resistance against higher temperatures and can improve reliability of the pipe.

Further, as in the second embodiment, a reheat pipe for reheating and feeding steam discharged from the high-pressure steam turbine to the medium-pressure steam turbine and a main steam pipe until an inlet of the high-pressure steam turbine on the boiler side can also be formed in the same manner.

(Fourth Embodiment)

In this fourth embodiment, the steam temperature of the high-pressure steam turbine is set to 538° C. To be adapted for that temperature, the main steam pipe and the reheat pipe are each made of steel containing 0.09-0.20% by mass of C, 0.15-0.75% of Si, 0.20-1.00% of Mn, not more than 0.50% of Ni, 0.9-1.65% of Cr, 0.80-1.30% of Mo, 0.05-0.35% of V, and the balance of Fe. In this fourth embodiment, the main steam pipe and the reheat pipe are each manufactured by the centrifugal casting in the same manner as in the second embodiment. More specifically, those pipes are manufactured through the steps of heating to and holding at 1025-1075° C., cooling by blast-cooling, heating to and holding at 690-730° C., and cooling in a furnace, thereby forming a bainite structure. The main steam pipe is manufactured as a pipe which comprises a flange and a straight portion expect for an elbow similarly to the second embodiment, the pipe being adapted for a portion until the inlet of the high-pressure steam turbine on the boiler side and a portion of the high-pressure steam turbine.

In this fourth embodiment, the main steam pipe is joined by welding to the elbow, which is formed of a forged pipe having the same crystal structure and alloy composition as those in the second embodiment and which is connected to the outer casing through the elbow. Thus, in this fourth embodiment, by employing, as a pipe material, the centrifugal casting material normalized to contain uniform and finer crystal grains, the steam turbine power plant is obtained which can achieve resistance against higher temperatures and can improve reliability of the pipe.

What is claimed is:

1. A pipe for a steam turbine wherein the pipe is formed of a centrifugal casting material made of martensitic steel having a columnar structure in the radial direction with the crystal grain size number of 5 or more in a plane perpendicular to the radial direction.

2. The pipe for the steam turbine according to claim 1, wherein said steel contains 0.05-0.5% by mass of C, not more than 1.0% of Si, 0.05-1.5% of Mn, 0.01-2.5% of Ni, 8.0-13.0% of Cr, 0.05-2.5% of Mo, not more than 3.0% of W, 0.05-0.35% of V, 0.01-0.5% of Nb, not more than 5% of Co, 0.01-0.1% of N, not more than 0.03% of B, and not more than 0.05% of Al.

3. The pipe for the steam turbine according to claim 1, wherein said steel is made of 0.07-0.20% by mass of C, 0.2-0.6% of Si, 0.3-0.7% of Mn, 0.2 -0.8% of Ni, 8.0-13.0% of Cr, 0.9-1.8% of Mo, 0.1-0.7% of W, 0.05-0.35% of V, 0.01-0.3% of Nb, 0.01-0.1% of N, 0.005-0.02% of Al, and the balance being unavoidable impurities and iron.

4. The pipe for the steam turbine according to claim 1, wherein said steel is made of 0.07-0.20% by mass of C, 0.2-0.6% of Si, 0.3-0.7% of Mn, 0.2 -0.8% of Ni, 8.0-13.0% of Cr, 0.5-1.2% of Mo, 1.0-3.0% of W, 0.05-0.35% of V, 0.01-0.3% of Nb, 0.5-2.0% of Co, 0.01-0.1% of N, 0.003-0.02% of B, 0.005-0.02% of Al, and the balance being unavoidable impurities and iron.

5. The pipe for the steam turbine according to claim 1, wherein said centrifugal casting material has smooth-specimen creep rupture strength of not less than 95 MPa at 600° C. and 100,000 hours, and tensile strength of not less than 570 MPa at room temperature.

6. The pipe for the steam turbine according to claim 1, wherein said centrifugal casting material has a flange at one end at least.

7. A main steam pipe for a steam turbine, wherein a main steam pipe for feeding high-temperature and high-pressure main steam to a high-pressure steam turbine or a high- and medium-pressure integral steam turbine is formed of one of (1) a pipe formed of a centrifugal casting material made of martensitic steel having a columnar structure in the radial direction with the crystal grain size number of 5 or more in a plane perpendicular to the radial direction, and (2) a pipe manufactured by a manufacturing process comprising the steps of preparing ferrite-based molten steel by cradle refining; pouring the ferrite-based molten steel into a rotating cylindrical mold including a ceramic wash formed on an inner surface of said mold, thereby to perform centrifugal casting; and forming a columnar structure in the radial direction with the crystal grain size number of 5 or more in a plane perpendicular to the radial direction.

8. A reheat pipe for a steam turbine, wherein a reheat pipe for reheating steam discharged from a high-pressure steam turbine and feeding the reheated steam to a medium-pressure steam turbine or a reheat pipe for reheating steam discharged from a high-pressure section of a high- and medium-pressure integral steam turbine and feeding the reheated steam to a medium- pressure section of said high- and medium-pressure integral steam turbine is formed of one of (1) a pipe formed of a centrifugal casting material made of martensitic steel having a columnar structure in the radial direction with the crystal grain size number of 5 or more in a plane perpendicular to the radial direction, and (2) a pipe manufactured by a manufacturing process comprising the steps of preparing ferrite-based molten steel by cradle refining; pouring the ferrite-based molten steel into a rotating cylindrical mold including a ceramic wash formed on an inner surface of said mold, thereby to perform centrifugal casting; and forming a columnar structure in the radial direction with the crystal grain size number of 5 or more in a plane perpendicular to the radial direction.

9. A steam turbine power plant comprising a high-pressure steam turbine, a medium-pressure steam turbine and a single low-pressure steam turbine, or comprising a high-pressure steam turbine, a medium-pressure steam turbine and two low-pressure steam turbines coupled to each other in tandem, wherein at least a main steam pipe for feeding high-temperature and high-pressure main steam to said high-pressure steam turbine is formed of one of (1) a pipe formed of a centrifugal casting material made of martensitic steel having a columnar structure in the radial direction with the crystal grain size number of 5 or more in a plane perpendicular to the radial direction, and (2) a pipe manufactured by a manufacturing process comprising the steps of preparing ferrite-based molten steel by cradle refining; pouring the ferrite-based molten steel into a rotating cylindrical mold including a ceramic wash formed on an inner surface of said mold, thereby to perform centrifugal casting; and forming a columnar structure in the radial direction with the crystal grain size number of 5 or more in a plane perpendicular to the radial direction, or a reheat pipe for reheating steam discharged from said high-pressure steam turbine and feeding the reheated steam to said medium-pressure steam turbine is formed of one of (1) a pipe formed of a centrifugal casting material made of martensitic steel having a columnar structure in the radial direction with the crystal grain size number of 5 or more in a plane perpendicular to the radial direction, and (2) a pipe manufactured by a manufacturing process comprising the steps of preparing ferrite-based molten steel by cradle refining; pouring the ferrite-based molten steel into a rotating cylindrical mold including a ceramic wash formed on an inner surface of said mold, thereby to perform centrifugal casting; and forming a columnar structure in the radial direction with the crystal grain size number of 5 or more in a plane perpendicular to the radial direction, said main steam pipe being joined by welding to an external casing of said high-pressure steam turbine through an elbow pipe.

10. A steam turbine power plant according to claim 9, wherein said outer casing is made of cast steel containing 0.06-0.2% by mass of 0,1.5-2.5% of Cr, and 0.5-1.5% of Mo.

11. A steam turbine power plant according to claim 9, wherein said high-pressure steam turbine or said high- and medium-pressure integral steam turbine has an inner casing within said outer casing, and said inner casing is made of cast steel containing 0.09-0.14% by mass of C, not more than 0.3% of Si, 0.40-0.70% of Mn, 8-10% of Cr, 0.4-0.7% of Ni, 0.15-0.25% of V, 0.04-0.08% of Nb, 0.02-0.06% of N, 0.40-0.80% of Mo, 1.4-1.9% of W, and 0.00 1-0.0025% of B.

12. A steam turbine power plant comprising a high- and medium-pressure integral steam turbine and a single low-pressure steam turbine, or comprising a high- and medium-pressure integral steam turbine and two low-pressure steam turbines coupled to each other in tandem, wherein at least a main steam pipe for feeding high-temperature and high-pressure main steam to said high- and medium-pressure integral steam turbine is formed of one of (1) a pipe formed of a centrifugal casting material made of martensitic steel having a columnar structure in the radial direction with the crystal grain size number of 5 or more in a plane perpendicular to the radial direction, and (2) a pipe manufactured by a manufacturing process comprising the steps of preparing ferrite-based molten steel by cradle refining; pouring the ferrite-based molten steel into a rotating cylindrical mold including a ceramic wash formed on an inner surface of said mold, thereby to perform centrifugal casting; and forming a columnar structure in the radial direction with the crystal grain size number of 5 or more in a plane perpendicular to the radial direction, or a reheat pipe for reheating steam discharged from a high-pressure section of said high- and medium-pressure integral steam turbine and feeding the reheated steam to a medium-pressure section of said high- and medium-pressure integral steam turbine is formed of one of (1) a pipe formed of a centrifugal casting material made of martensitic steel having a columnar structure in the radial direction with the crystal grain size number of 5 or more in a plane perpendicular to the radial direction, and (2) a pipe manufactured by a manufacturing process comprising the steps of preparing ferrite-based molten steel by cradle refining; pouring the ferrite-based molten steel into a rotating cylindrical mold including a ceramic wash formed on an inner surface of said mold, thereby to perform centrifugal casting; and forming a columnar structure in the radial direction with the crystal grain size number of 5 or more in a plane perpendicular to the radial direction, said main steam pipe being joined by welding to an external casing of said high- and medium-pressure integral steam turbine through an elbow pipe.

* * * * *